US005570646A

United States Patent [19]

Mardix et al.

[11] Patent Number: 5,570,646

[45] Date of Patent: Nov. 5, 1996

[54] DEVICE FOR USE WITH A BOBBIN-LESS COIL OF THREAD

[75] Inventors: Bar-Cochva Mardix, Tel Aviv; Yaacov Sadeh, Ness Ziona, both of Israel

[73] Assignee: Orisol Original Solutions Ltd., Rishon Lezion, Israel

[21] Appl. No.: 281,470

[22] Filed: Jul. 27, 1994

[30] Foreign Application Priority Data

Jul. 30, 1993 [IL] Israel ..... 106535

[51] Int. Cl.[6] ..... D05B 45/00

[52] U.S. Cl. ..... 112/278; 242/173

[58] Field of Search ..... 112/278, 273, 112/275, 277, 228, 231; 242/173, 18 R, 7.01, 360, 47, 118.4

[56] References Cited

U.S. PATENT DOCUMENTS

| | | | |
|---|---|---|---|
| 1,396,481 | 11/1921 | Vaughan | 242/118.4 |
| 1,456,108 | 5/1923 | Johannesen | 242/118.4 X |
| 2,148,339 | 2/1939 | Cryan | 242/173 X |
| 2,732,817 | 1/1956 | Robinson | 242/173 |
| 2,808,795 | 10/1957 | Wortham | 112/252 |
| 2,854,938 | 10/1958 | Winberg | 112/278 |
| 3,474,747 | 10/1969 | Noiles | 112/2 |
| 3,738,296 | 6/1973 | Mackenzie et al. | 112/219 R |
| 3,843,883 | 10/1974 | De Vita et al. | 250/233 |
| 3,991,692 | 11/1976 | Papajewski et al. | 112/278 |
| 4,163,158 | 7/1979 | Coughenour et al. | 250/561 |
| 4,186,672 | 2/1980 | Burton | 112/273 |
| 4,188,902 | 2/1980 | Kahan | 112/278 |
| 4,192,243 | 3/1980 | Blessing et al. | 112/273 |
| 4,196,685 | 4/1980 | Tamura | 112/273 |
| 4,212,257 | 7/1980 | Herron et al. | 112/278 |
| 4,223,618 | 9/1980 | Cislak | 112/186 |
| 4,237,807 | 12/1980 | Meier et al. | 112/278 |
| 4,276,910 | 7/1981 | Eichenberger | 139/273 |
| 4,419,946 | 12/1983 | Fischer et al. | 112/121.12 |
| 4,497,269 | 2/1985 | Schneider et al. | 112/262.3 |
| 4,498,404 | 2/1985 | Sadeh | 112/121.12 |
| 4,569,298 | 2/1986 | Lindh et al. | 112/278 |
| 4,602,582 | 7/1986 | Rawson | 112/278 |
| 4,693,196 | 9/1987 | Hager | 112/273 |
| 4,732,098 | 3/1988 | Mertel et al. | 112/278 |
| 4,932,343 | 6/1990 | Mardix et al. | 112/121.12 |
| 4,934,292 | 6/1990 | Mardix et al. | 112/273 |
| 5,078,331 | 1/1992 | Mardix et al. | 242/118.4 |
| 5,143,004 | 9/1992 | Mardix et al. | 112/186 |
| 5,161,475 | 11/1992 | Tawara et al. | 112/278 |

FOREIGN PATENT DOCUMENTS

| | | |
|---|---|---|
| 2045435 | 9/1970 | Germany . |
| 2554022 | 12/1975 | Germany . |
| 3447138 | 7/1986 | Germany . |
| 3800717 | 5/1989 | Germany . |
| 75666 | 7/1988 | Israel . |
| 1335677 | 10/1973 | United Kingdom . |
| 2078798 | 1/1982 | United Kingdom . |

*Primary Examiner*—Peter Nerbun
*Attorney, Agent, or Firm*—Ladas & Parry

[57] ABSTRACT

A device, preferably of disc configuration, capable of being fastened to a bobbin-less coil of thread for indicating the non-rotation of the coil during a sewing operation. One side of the device includes indicating means enabling the optical detection of the rotation of the device. The opposite side of the device includes fastening means, such as pins or adhesive, for fastening the device to a coil of thread, the fastening means being capable of disengaging from the coil when a predetermined length of thread remains therein.

20 Claims, 3 Drawing Sheets

DEVICE FOR USE WITH A BOBBIN-LESS COIL OF THREAD

FIELD OF THE INVENTION

The present invention relates to a device for monitoring the rotation of the bobbin thread of a sewing machine, particularly while using a pre-wound bobbin.

BACKGROUND OF THE INVENTION

The known sewing machines are provided with various means for feeding an upper thread to the sewing needle, and other means, including a bobbin, for feeding the lower thread to the sewing needle. Monitoring the condition, particularly breakage, of the upper thread is relatively simple, and several methods are in use today, as described for example in U.S. Pat. No. 3,843,883. However, monitoring the condition of the lower bobbin thread is somewhat more problematical, and although a number of systems have been devised for doing this, the known systems are still not entirely satisfactory. The main reason for this is because of the complexity of the path of the lower thread out of the bobbin, which enables very little room for detection. Various methods for detecting an empty bobbin condition using a light beam are known, for example as described in U.S. Pat. Nos. 4,237,807 and 4,212,257, and in British Patents 1,335,677 and 2,078,798. However, these known techniques are usually of complicated construction and generally do not detect all the conditions of the bobbin thread, including thread exhaustion and thread breakage.

Our prior U.S. Pat. No. 4,934,292 disloses an arrangement for detecting when a bobbin stops rotating, e.g., because of an empty bobbin. The detection of this condition may be used for terminating the operation of the sewing machine to enable refilling or replacement of the empty bobbin and to continue with the stitching operations.

Those specifications relate to a conventional bobbin on which the thread is wound. Recently, however, "pre-wound bobbins" have gained popularity. These are coils of thread without a bobbin, held together by a weak glue so as not to interfere with the release of the thread. By leaving out the bobbin, the need to rewind the thread on the sewing head is eliminated, thus saving time and trouble. This bobbin-less coil of thread, however, cannot be used with the detecting arrangements disclosed in the above patent specifications.

Another problem with sewing machines arises when a stitching operation is terminated in the middle because of an empty bobbin and is then resumed with a new bobbin. This results in a break in the stitch and is particularly unsightly in "top stitchings", such as collars, cuffs, pockets, etc., viewable from the outside of the garment, as distinguished from "inside stitches" which are not viewable from the outside of the garment.

Our prior U.S. Pat. No. 4,934,292 discloses a bobbin structure which permits the bobbin, even when it stops rotating, to nevertheless supply a sufficient length of thread in order to finish a stitching operation. However, this structure is also incompatible with the use of a bobbin-less coil of thread.

OBJECTS AND SUMMARY OF THE INVENTION

It is an object of the invention to provide a device capable of adapting a bobbin-less coil of thread for use with the detecting apparatuses disclosed in our aforementioned patent specifications.

It is a further object of the invention to permit a sewing operation using a bobbin-less coil of thread to be completed even when the coil stops rotating.

In accordance with the present invention, there is provided an indicator device capable of being fastened to a bobbin-less coil of thread for indicating the non-rotation of the coil during a sewing operation, the thread of the bobbin-less coil being held together in a cylindrical coil form by weak glue which permits easy release and unwinding of the thread from the coil. The indicator device comprises a disc-shaped member having an inner face to face the end face of the coil when fastened thereto, and an outer face facing away from the coil. The outer face includes indicating means enabling the optical detection of the rotation of the device, and the inner face includes fastening means for fastening the device to the coil of thread. The fastening means is fastenable to the end face of the coil at a predetermined radial distance from the center of the coil so that the disc-shaped member is released from the coil when a predetermined length of thread remains in the coil. The arrangement is such that the disc-shaped member rotates with the coil as thread is unwound therefrom but ceases to rotate with the coil when only the predetermined length of thread remains in the coil.

In accordance with the present invention there is also provided a sewing apparatus comprising a sewing head including a drive therefor; a bobbin-less coil of thread for feeding thread to the sewing head; the aforementioned device fastened to the coil for indicating its non-rotation; a bobbin case for holding the coil and the device; and an optical sensor for optically sensing the indicating means and for producing a train of pulses during the rotation of the coil, such that the termination of the train of pulses by the non-rotation of the coil indicates a break in, or the exhaustion of, the thread of the coil.

By using the above device, bobbin-less coils of thread can be monitored for breakage and/or exhaustion of thread using the apparatuses described in our aforementioned patents. Additionally, the use of the device of the invention prevents the unsightly break which normally is produced in a stitch when interrupted in the middle of a stitching operation.

Further features and advantages of the invention will be apparent from the description below.

BRIEF DESCRIPTION OF THE DRAWINGS

The invention is herein described, by way of example only, with reference to the accompanying drawings, wherein.

DESCRIPTION OF PREFERRED EMBODIMENTS

Figure 1:
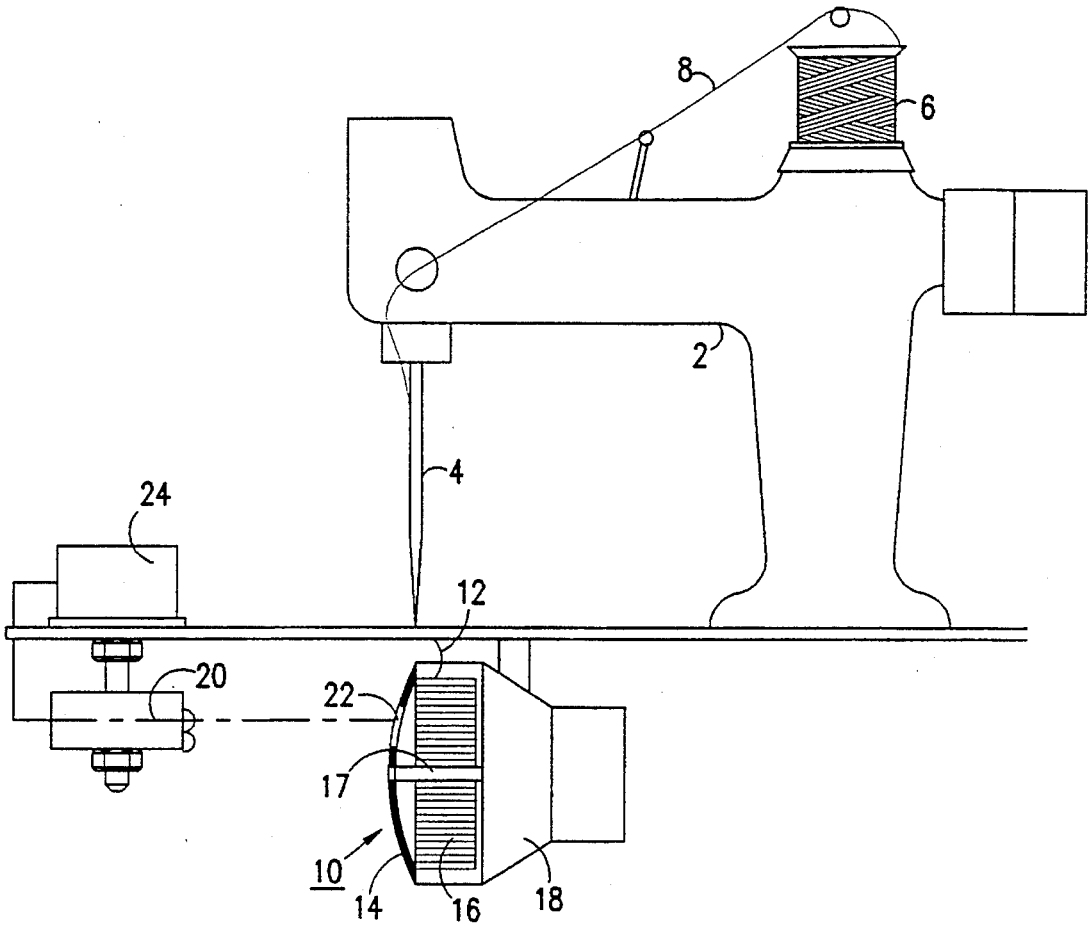
FIG. 1 is a side elevational view illustrating the main components of a sewing apparatus which can be used with the device of the invention.

Referring now to FIG. 1, there is illustrated a sewing machine head, generally designated 2, including a reciprocating sewing needle 4, a spool 6 for feeding an upper thread 8 to the sewing needle, and a lower thread unit 10 for feeding the lower thread 12 to the sewing needle. The lower thread unit 10 comprises a bobbin case 14; a conventional bobbin 16 disposed within the case and on which is wound a supply of the lower thread 12; a bobbin case mounting axis 17 on which is mounted the bobbin; and a rotary housing 18 which is rotated in synchronism with the reciprocation of the sewing needle and the other components of the sewing machine, so as to form stitches with the upper thread 8. The general construction and mode of operation of such sewing machines are well-known, and therefore further details not essential to an understanding of the present invention are not set forth herein.

FIG. 1 also illustrates an optical sensor 20 aligned with an opening 22 in the end wall of the bobbin case 14 for monitoring the rotation of the bobbin. The pulses generated by the optical sensor 20 are fed into a control and indicating unit 24. The operation of the sensor and unit with a conventional bobbin were previously described in our prior U.S. Pat. No. 4,934,292, hereby incorporated by reference.

Figure 2:
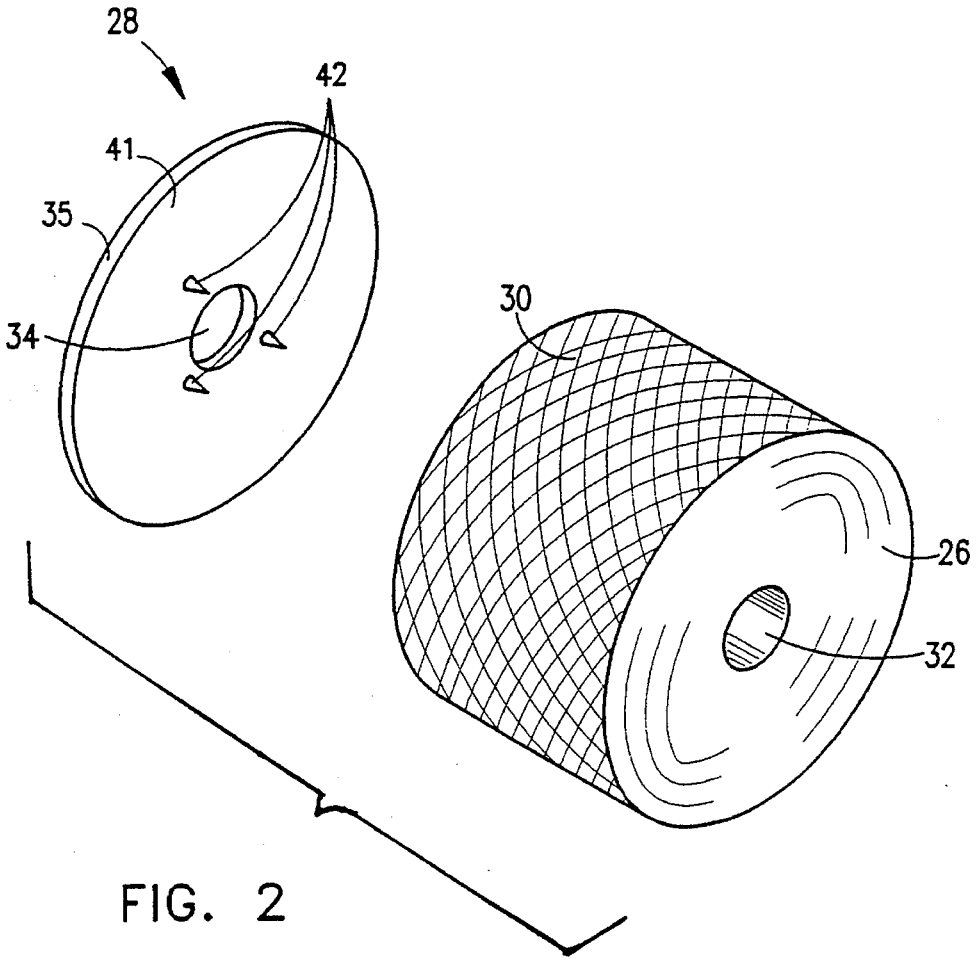
FIG. 2 is a perspective view of a bobbin-less coil and a device in accordance with one embodiment of the present invention.

A bobbin-less coil of thread 26 is illustrated in FIG. 2 together with one embodiment of the device of the invention in the form of a thin, flat disc-shaped member or disc 28. The coil 26 has a cylindrical shape and is wholly composed of threads 30 held together by a weak glue which permits easy release and unwinding of the thread from the coil. An axial bore 32 traverses the center of the coil to enable it to be mounted on the bobbin case mounting axis 17 (FIG. 1). As the thread 30 is fed to the needle, the coil rotates on the mounting axis until the supply of thread has been completely exhausted. A new coil is then inserted in its place, eliminating the need for rewinding the bobbin.

The disc 28 will usually have a diameter similar to the diameter of the new bobbin-less coil, and an axial bore 34 traversing its center to allow the disc to be mounted on the bobbin case mounting axis. The disc has an inner face (41, FIG. 2) facing the end face of the coil 26 when fastened thereto, and an outer face (36, FIG. 3) facing away from the coil. Disc 28 is preferably exceedingly thin, with a thickness 35 in the range of 0.15–0.25 mm, so as to be insertable into the bobbin case without interferring with the rotation of the coil. Due to its thinness, the disc will usually be made from a rigid material such as a metal, preferably steel, so as to impart strength to the disc. However, a disposable disc made from a lightweight, inexpensive material such as cardboard is also contemplated.

Figure 3:
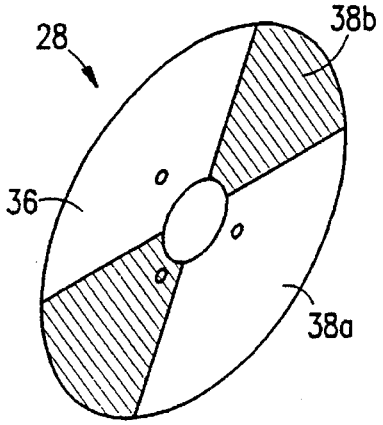
FIG. 3 is a perspective view of the opposite side of the device of FIG. 2.
Figure 5:
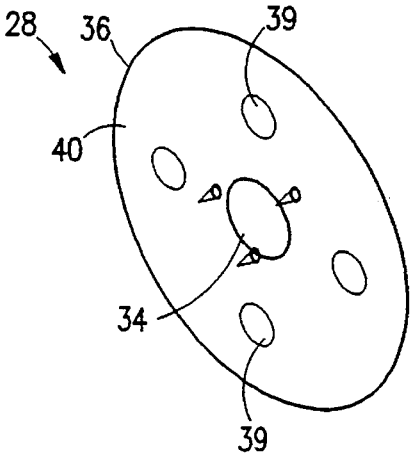
FIG. 5 is a perspective view of an alternate embodiment in accordance with the invention.

FIG. 3 illustrates the outer or 'indicating' face 36 of the disc 28 which is coated with alternate reflecting 38*a* and non-reflecting 38*b* circumferentially spaced strips extending radially from the center of the disc. The strips can be of different colors (e.g. black and white) or of different optically-sensible materials. The only condition is that one of the strips be sensed by the optical sensor 20 (FIG. 1) during the rotation of the disc, as described in our aforementioned patent specifications in relation to the outer face of the end wall of the bobbin. An alternate embodiment is illustrated in FIG. 5 wherein the 'indicating' face 36 of the disc has circumferentially spaced holes 39 cut out of a reflecting background 40.

The opposite face 41 of the disc 28, illustrated in FIG. 2, contains fastening means in the form of three pointed pins 42 circumferentially arranged around the axial bore 34. The tips of the pins project outwardly from the surface of face 41 in order to engage the threads of the coil 26.

Figure 4A:
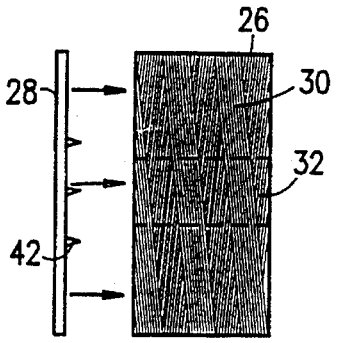
FIGS. 4*a*–4*c* are side elevational views illustrating the engagement of the coil by the device of FIG. 2.
Figure 4B:
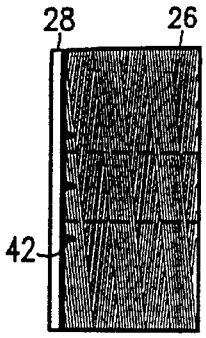
Figure 4C:
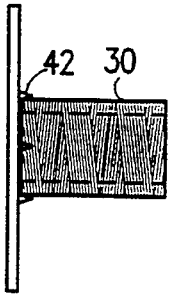

FIGS. 4*a*–4*c* illustrate the mounting of the disc 28 on the coil 26 and its operation. The disc 28 is mounted concentrically onto the coil 26 with the pins 42 engaging the threads of the coil. As the thread is fed to the needle, the coil rotates around its axis 32 and the disc rotates concurrently. The optical sensor senses the alternate strips 38 (FIG. 3) and generates pulses which are fed to the control unit 24 (FIG. 1). When the thread supply has been exhausted, the pins 42 will no longer engage the thread 30 (FIG. 4*c*) causing the disc to release or disengage from the coil. The disc will then cease to rotate, and the non-rotation will be sensed by the optical sensor, which will feed the information to the control unit. The control unit can then inform the operator of the situation and/or automatically stop the sewing machine. In a similar manner, if the thread breaks during the sewing process, the coil will cease to rotate, and the resulting non-rotation of the disc will likewise be sensed by the sensor.

In the case of thread exhaustion, the position of the pins on the disc will determine how much thread remains in the coil when the disc ceases to rotate. Referring to FIG. 2, if the location of the pins 42 borders on the bore 34, a minimal amount of threads 30 will remain in the coil on release of the disc from the coil. As the distance of the pins from the bore increases, a longer length of thread will remain in the coil. This is advantageous for avoiding a break in the stitch which results when a bobbin is depleted in the middle of a sewing operation. By positioning the pins a predetermined radial distance from the axial bore at the center of the disc, a predetermined length of thread will remain in the coil on release of the disc, as is illustrated in FIG. 4*c*. This remaining length of thread will permit the coil, even when it stops rotating, to nevertheless supply a sufficient length of thread in order to finish a stitching operation.

Figure 6:
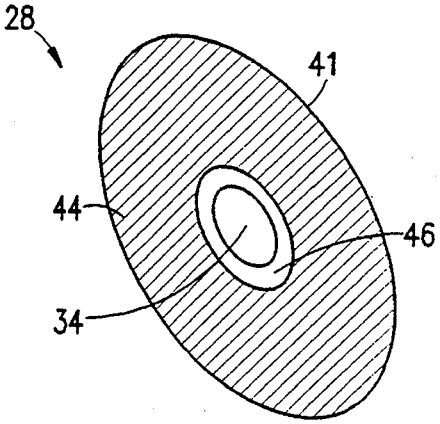
FIG. 6 is a perspective view of a further embodiment in accordance with the invention.

FIG. 6 illustrates an alternate embodiment to the pin-mounted disc, in the form of an adhesive coating 44 on the 'fastening' face 41 of the disc. The adhesive fulfills the same fastening function as the pins, and the width of an adhesive-less ring 46 surrounding the axial bore 34 determines the length of thread which will remain in the coil on release of the disc from the coil.

Figure 7:
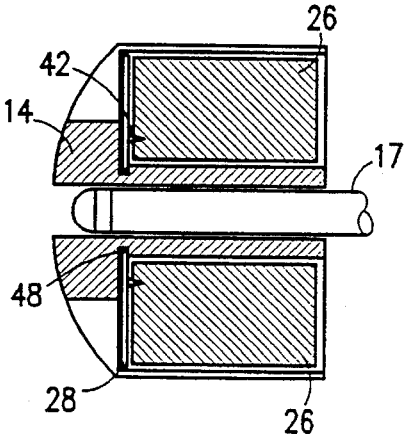
FIG. 7 is a side sectional view of a bobbin case containing a coil and a device according to another embodiment of the invention.

The disc described above can be fastened to the coil externally of the bobbin case and the disc-coil combination can then be inserted into the case. FIG. 7 illustrates an alternate embodiment in which the disc 28 is permanently held in the bobbin case 14 by a recess 48 on the case shaft which, however, allows the disc to freely rotate inside the case. The coil 26 is inserted into the case 14 and pressed against the pins 42 of the disc so as to be engaged by the disc. This embodiment eliminates the need to accurately position the disk on the coil prior to inserting the coil into the bobbin case.

While the invention has been described with respect to several preferred embodiments, it will be appreciated that many other variations, modifications and applications of the invention may be made.

We claim:

1. An indicator device capable of being fastened to a bobbin-less coil of thread for indicating the non-rotation of said coil during a sewing operation, the thread of said bobbin-less coil being held together in a cylindrical coil form by weak glue which permits easy release and unwinding of the thread from the coil, said device comprising a disc-shaped member having an inner face to face an end face of the coil when fastened thereto, and an outer face to face away from said coil; said outer face including indicating means enabling the optical detection of the rotation of said device, said inner face including fastening means for fastening said device to said coil of thread, said fastening means being fastenable to the end face of the coil at a predetermined radial distance from the center of the coil so as to release said disc-shaped member from said coil when a predetermined length of thread remains therein such that the disc-shaped member rotates with the coil as thread is unwound therefrom but ceases to rotate with the coil when only said predetermined length of thread remains therein.

2. The device according to claim 1, wherein said predetermined radial distance from the center of the coil at which said fastening means is fastenable to the coil is such that said predetermined length of thread is sufficient to finish a stitching operation.

3. The device according to claim 1, wherein said fastening means comprises a plurality of pins circumferentially arranged around the center of said inner face of the disc-shaped member and projecting therefrom so as to be capable of engaging said end face of the coil of thread.

4. The device according to claim 3, wherein said pins are positioned a predetermined radial distance from the center of said inner face of the disc-shaped member to engage the end face of said coil such that said predetermined length of thread is sufficient to finish a stitching operation.

5. The device according to claim 1, wherein said fastening means comprises an adhesive material coating said inner face of the disc-shaped member except for the surface thereof to be released from said end face of the coil.

6. The device according to claim 5, wherein said adhesive material extends from the outer edge of said inner face of the disc-shaped member to a ring located at said predetermined radial distance from the center of said inner face of the disc-shaped member so as to engage the end face of said coil up to the outer end of said predetermined length of thread.

7. The device according to claim 1, wherein said indicating means comprises a plurality of circumferentially spaced optically-sensible markings extending radially to the outer edge of said inner face of the disc-shaped member.

8. The device according to claim 1, wherein said indicating means comprises a plurality of circumferentially spaced holes formed through said disc-shaped member.

9. The device according to claim 1, wherein said disc-shaped is a thin flat disc having a centrally-located bore.

10. An assembly comprising:

a bobbin-less coil of thread and an indicator device fastened thereto for indicating the non-rotation of said coil during a sewing operation;

the thread of said bobbin-less coil being held together in a cylindrical coil form by weak glue which permits easy release and unwinding of the thread from the coil;

said device comprising a disc-shaped member having an inner face to face the end face of the coil when fastened thereto, and an outer face to face away from said coil;

said outer face including indicating means enabling the optical detection of the rotation of said device;

said inner face including fastening means for fastening said indicator device to said coil of thread;

said fastening means being fastened to the end face of the coil at a predetermined radial distance from the center of the coil so as to release said disc-shaped member from said coil when a predetermined length of thread remains therein such that the disc-shaped member rotates with the coil as thread is unwound therefrom but ceases to rotate with the coil when only said predetermined length of thread remains therein.

11. The device according to claim 10, wherein said predetermined radial distance from the center of the coil at which said fastening means is fastenable to the coil is such that said predetermined length of thread is sufficient to finish a stitching operation.

12. The device according to claim 10, wherein said fastening means comprises a plurality of pins circumferentially arranged around the center of said inner face of the disc-shaped member and projecting therefrom so as to engage said end face of the coil of thread.

13. The device according to claim 12, wherein said pins are positioned a predetermined radial distance from the center of said inner face of the disc-shaped member to engage the end face of said coil such that said predetermined length of thread is sufficient to finish a stitching operation.

14. The device according to claim 10, wherein said fastening means comprises an adhesive material coating said inner face of the disc-shaped member except for the surface thereof released from the end face of the coil.

15. The device according to claim 14, wherein said adhesive material extends from the outer edge of said inner face of the disc-shaped member to a ring located at a predetermined radial distance from the center of said inner face of the disc-shaped member so as to engage the end face of said coil up to the outer end of said predetermined length of thread.

16. The device according to claim 10, wherein said indicating means comprises a plurality of circumferentially spaced optically-sensible markings extending radially to the outer edge of said inner face of the disc-shaped member.

17. The device according to claim 10, wherein said indicating means comprises a plurality of circumferentially spaced holes formed through said disc-shaped member.

18. A sewing apparatus comprising: a sewing head including a drive therefor; a bobbin-less coil of thread for feeding thread to said sewing head, the thread of said bobbin-less coil being held together in a cylindrical coil form by weak glue which permits easy release and unwinding of the thread from the coil; an indicator device fastened to said coil for indicating its non-rotation, said indicator device comprising a disc-shaped member having an inner face facing an end face of the coil, and an outer face facing away from said coil, said outer face including indicating means enabling the optical detection of the rotation of said device, said inner face including fastening means for fastening said device to said coil of thread at a predetermined radial distance from the center of the coil so as to release said disc-shaped member from said coil when a predetermined length of thread remains therein such that the disc-shaped member rotates with the coil as thread is unwound therefrom but ceases to rotate with the coil when only said predetermined length of thread remains therein; a bobbin case for holding said coil and said device; and an optical sensor for optically sensing said indicating means and for producing a train of pulses during the rotation of said coil, such that the termination of the train of pulses by the non-rotation of the coil indicates a break in, or the exhaustion of, said thread of said coil.

19. The sewing apparatus of claim 18, wherein said device with said coil fastened thereto is removably mounted in said bobbin case.

20. The sewing apparatus of claim 18, wherein said device is permanently held in said bobbin case and said coil is fastened to it in situ.

* * * * *